US006378711B1

(12) United States Patent
Skulnik et al.

(10) Patent No.: US 6,378,711 B1
(45) Date of Patent: Apr. 30, 2002

(54) BEVELED BEAM

(75) Inventors: Martin A. Skulnik; Gary Smith, both of East Stroudsburg, PA (US)

(73) Assignee: United Steel Enterprises, Inc., East Stroudsburg, PA (US)

( * ) Notice: Subject to any disclaimer, the term of this patent is extended or adjusted under 35 U.S.C. 154(b) by 0 days.

(21) Appl. No.: 09/691,218

(22) Filed: Oct. 19, 2000

(51) Int. Cl.[7] ..... A47F 5/00

(52) U.S. Cl. ..... 211/183; 211/189; 211/191; 40/642.02

(58) Field of Search ..... 211/182, 183, 211/189, 191, 151, 187; 40/299.01, 642.01, 654.01, 642.02

(56) References Cited

U.S. PATENT DOCUMENTS 3,900,112 A * 8/1975 Azzi et al. ..... 211/151 X
4,383,614 A * 5/1983 Miller ..... 211/183 X
5,044,104 A * 9/1991 Hopperdietzel
5,197,215 A * 3/1993 Torsleff
5,295,591 A * 3/1994 Slater ..... 211/151 X
5,368,174 A * 11/1994 Clark et al. ..... 211/183
5,749,482 A * 5/1998 Clark ..... 211/183 X
5,769,249 A * 6/1998 Lascara ..... 211/191
5,845,794 A * 12/1998 Highsmith ..... 211/189
6,039,192 A * 3/2000 Hollander ..... 211/187 X

* cited by examiner

*Primary Examiner*—Robert W. Gibson, Jr.
(74) *Attorney, Agent, or Firm*—Charles E. Baxley, Esq.

(57) ABSTRACT

A beam for supporting an load such as a storage rack, platform or the like is provided whereby products in or on the article can be stored safely and displayed. In particular, the present invention includes a beam with a support element having a first and a second end, a continuous base portion having a turned portion positioned between the first and second ends of the support element, a beveled display portion joined to the continuous base portion, and a brace portion joining the display portion to the support element. The beam preferably has a closed cross section whereby all portions unitary with one another. An article such as a storage rack platform is loaded onto the support element while a bar code or other product information indicia are displayed on the beveled portion.

15 Claims, 5 Drawing Sheets

BEVELED BEAM

BACKGROUND OF THE INVENTION

1. Technical Field

The present invention generally relates to a beveled beam for framing a structure such as a storage rack, or the like. More particularly, the present invention relates to a beam having a beveled face and that is suitable typically for a bottom front surface of a storage rack.

2. Background Art

In warehouses or retail establishments, storage racks often are used for displaying and/or storing various products. Due to the weight and quantity of products within the storage racks, it is necessary for the racks to be sturdily supported. Moreover, a need to make efficient use of space requires such support to be sufficient to maintain worker and customer safety.

Heretofore, many artisans have attempted to provide support beams for storage racks and the like. One such example is shown in U.S. Pat. No. 5,769,249 to Lascara, the disclosure of which is incorporated herein by reference. Lascara shows a beam having a L-shaped flange for supporting a deck. However, the L-shaped flange of Lascara makes only minimal surface area contact with the deck and, accordingly, fails to provide adequate stability. Moreover, the beam of Lascara lacks a unitary structure whereby all portions of the beam are connected. In contrast, Lascara relies on two spaced apart flange portions for supporting weight imposed on the beam.

U.S. Pat. No. 5,749,482 to Clark, the disclosure of which is incorporated herein by reference, taught a storage rack beam. Specifically, the Clark beam includes a ledge for supporting an end portion of a deck and an inclined surface for receiving indicia. The beam of Clark, however, is configured with a ledge to receive only an end portion of a deck. If more of the deck is desired to be supported on the ledge, the entire beam must be made larger.

Therefore, there exists a need for a beam that is configured to provide maximum stability and support for a deck or an article placed thereon. Moreover, there exists a need for the beam to include a beveled surface so that bar codes or other indicia may be easily read or scanned by workers and customers.

SUMMARY OF THE INVENTION

The present invention overcomes deficiencies of the related art by including a beveled floor beam for s structure such as a storage rack or the like. Specifically, the beam includes a beveled front face, a support element and a continuous base portion having a turned edge positioned between first and second ends of the support element. Bar codes or other information may be displayed on the beveled front face so they can be read easily or scanned by consumers or workers. The support element extends in a direction such that optimal surface area contact with the article being supported can be maintained. Additional support is provided by the turned edge, which when contacting the support element, provides reinforcement thereto.

According to a first aspect of the present invention, a beam for a storage rack is disclosed. The beam comprises: (1) a support element having a first end and a second end; (2) a base portion having a turned portion, wherein the turned portion is positioned between the first end and the second end; and (3) a display portion joined to the base portion.

According to a second aspect of the present invention, a beam for a storage rack is disclosed. The beam comprises: (1) a first portion having a first end and a second end; (2) a second portion joined to the first end of the first portion; (3) a third portion extending angularly from the second end of the first portion; and (4) a bent portion having a first element and a second element, wherein the first element is joined to the second portion, and wherein the third portion extends towards the second element.

According to a third aspect of the present invention, a beam for a storage rack is disclosed. The beam comprises: (1) an angled base portion having a first element and a second element; (2) an inclined portion joined to the second element of the angled base portion; and (3) a stabilizing portion having an end turned towards the first element of the angled base portion.

It is therefore an advantage of the present invention to provide a beam for supporting a storage rack or the like, wherein maximum support and stability is provided. It is a further advantage of the present invention for the beam to include a beveled surface so that bar codes or other indicia can easily be read or scanned.

The preferred embodiment of the present invention is designed to solve the problems herein described and other problems not discussed, which are discoverable by a skilled artisan.

BRIEF DESCRIPTION OF THE DRAWINGS

The foregoing and other features and advantages of this invention will be more readily understood from a detailed description which follows of the various aspects of the invention taken in conjunction with accompanying drawings in which.

Figure 1A:
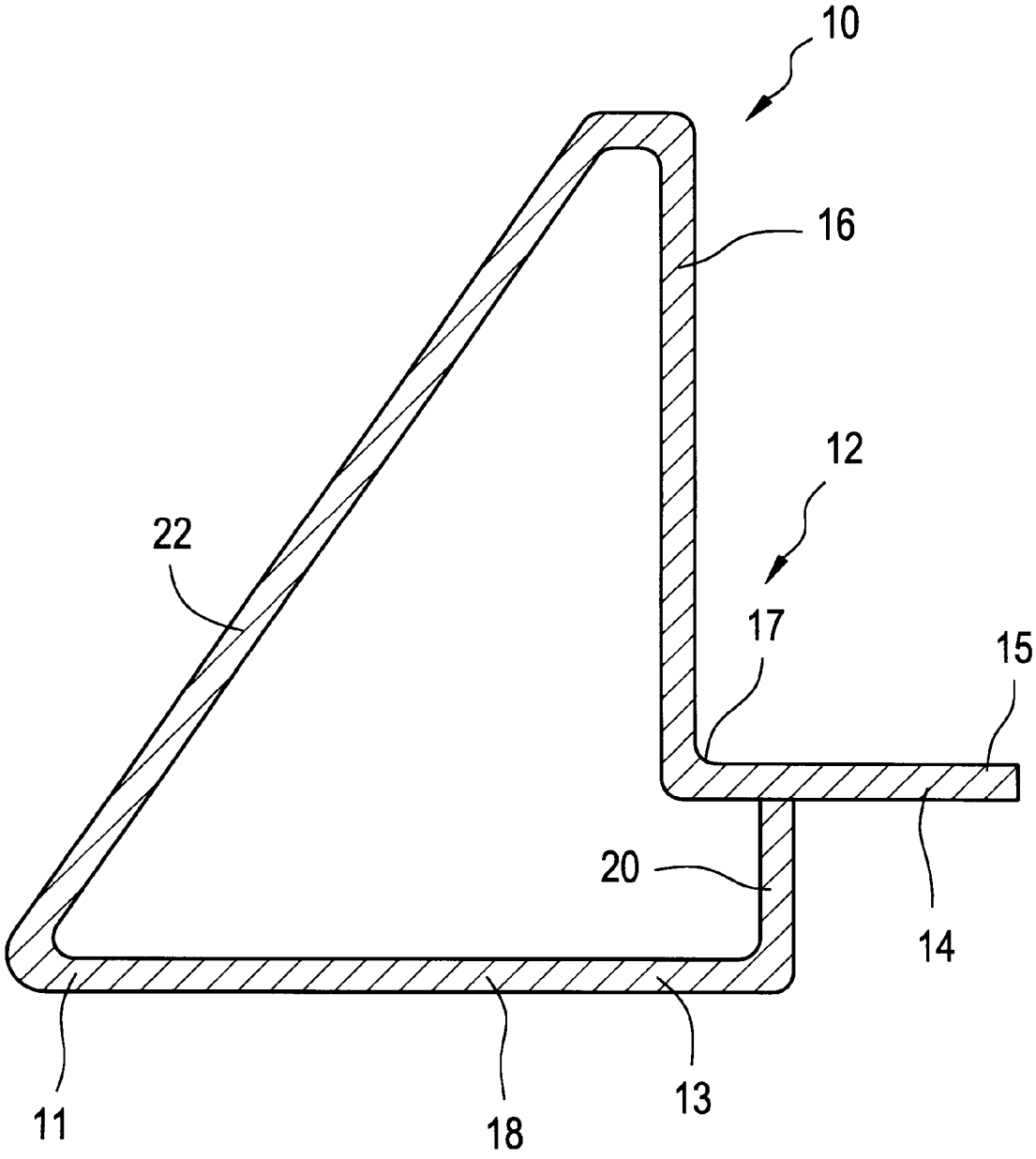
FIG. 1A depicts a side elevational view of a beam in accordance with a preferred embodiment of the present invention.

It is noted that the drawings of the invention are not necessarily drawn to scale. The drawings are merely schematic representations, not intended to portray specific parameters of the invention. The drawings are intended to depict only typical embodiments of the invention, and therefore should not be considered as limiting the scope of the invention. In the drawings, like numbering represents like elements among the drawings.

DETAILED DESCRIPTION OF THE DRAWINGS

Referring now to FIG. 1A, a beam generally designated 10 is show. The beam 10 includes a display portion 22, a continuous base portion 18, a turned edge 20, and a bent portion 12. The bent portion 12 includes a brace portion 16 and a support element 14. In a preferred embodiment, the turned edge 20 intersects and makes direct contact with the support element 14 between a first end 15 and a second end 17 thereof. Accordingly, the turned edge 20 is angular with respect to the support element 14 and substantially parallel to the brace portion 16. As depicted, the display portion 22 is beveled at a pre-determine angle to provide a surface for displaying human readable information, machine readable information (such as a bar code 26 shown in FIG. 2) or both. The beveled surface of the display portion 22 allows workers or customers easily to read and/or scan the information 26 to determine product identity, price, etc.

The continuous base portion 18 extends from the turned edge 20 to the display portion 22. The brace portion 16 extends from the upper edge of the display portion 22 to the support element 14. Accordingly, this preferred embodiment provides a "closed" configuration whereby all portions/surfaces of the beam 10 are connected or unitary with one another. Such unitary configuration offers improved stability and strength when a load is applied from various angular directions to the beam 10. This configuration is in contrast to the non-unitary beam of Lascara that provides two spaced apart flanges as a base means for supporting the load.

Figure 1B:
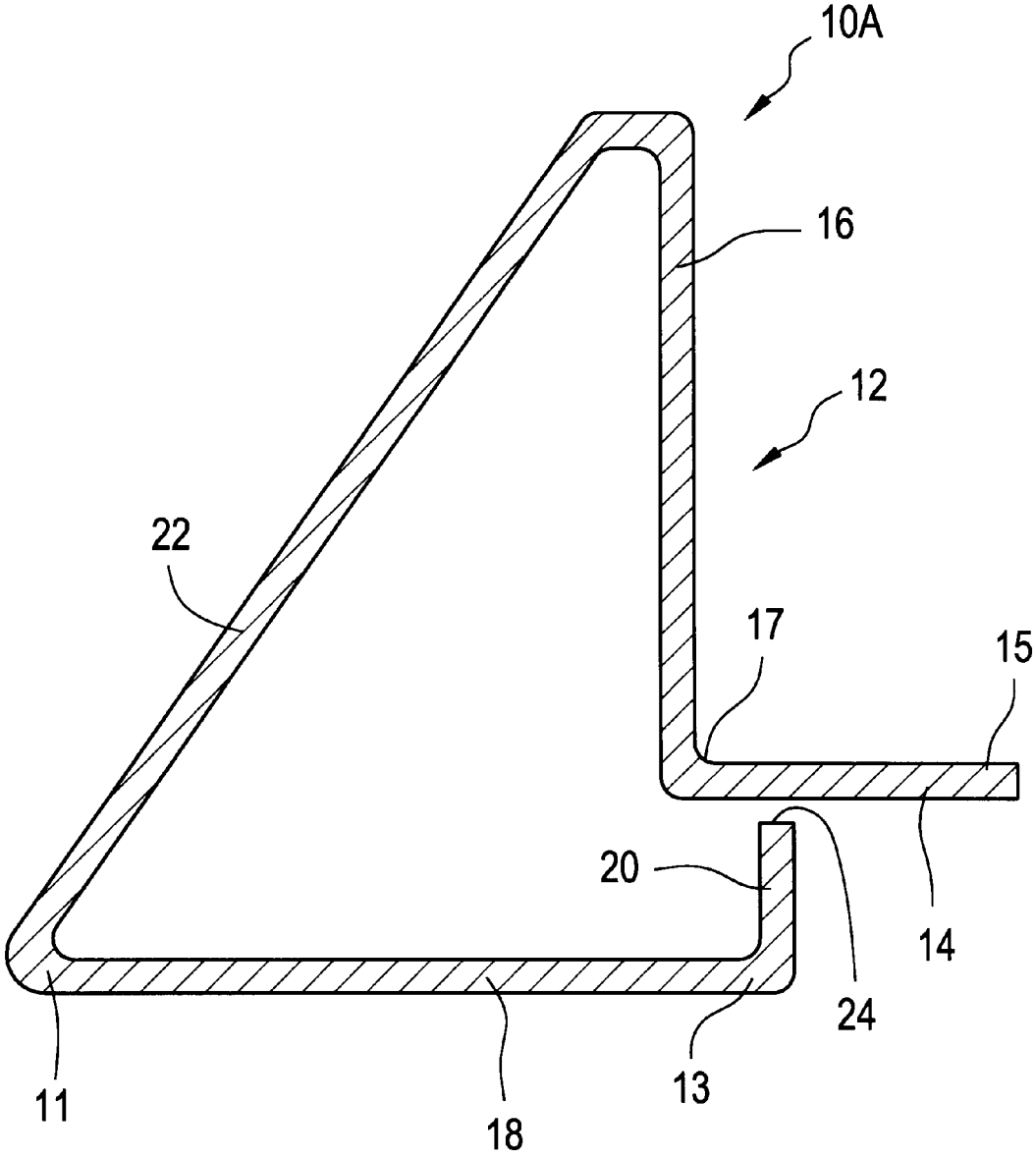
FIG. 1B depicts a side elevational view of a beam, in accordance with a first alternative embodiment of the present invention.

FIG. 1B shows an alternative embodiment beam 10A. As shown, the beam 10A includes the same components as the beam 10 of the preferred embodiment. However, the turned edge 20 is distally positioned adjacent the support element 14 such that a gap 24 is present between the turned edge 20 and the support element 14 when no load is applied to the support element 14. When a load is imposed on the support element 14, the load forces the support element to make contact with the turned edge 20 in the same manner as described for the beam 10 of FIG. 1A. Thusly, configuration and structural integrity are maintained when a load is applied downwardly onto the beam 10A.

It should be appreciated by those skilled in design that either beam 10 or 10A can be oriented at any position rotationally. In particular, the components of the beams 10, 10A can be represented as a first portion 18 having a first end 11 and a second end 13. A second portion 22 is joined to the first end 11 while a third portion 20 is angularly joined to the second end 13. A bent portion 12 is joined to the second portion 22 such that the third portion 20 is extending in the direction thereof. Accordingly, a user can orient the beam 10, 10A at various rotational positions without the first portion 18 serving as a "base" of the beam 10, 10A.

Figure 2:
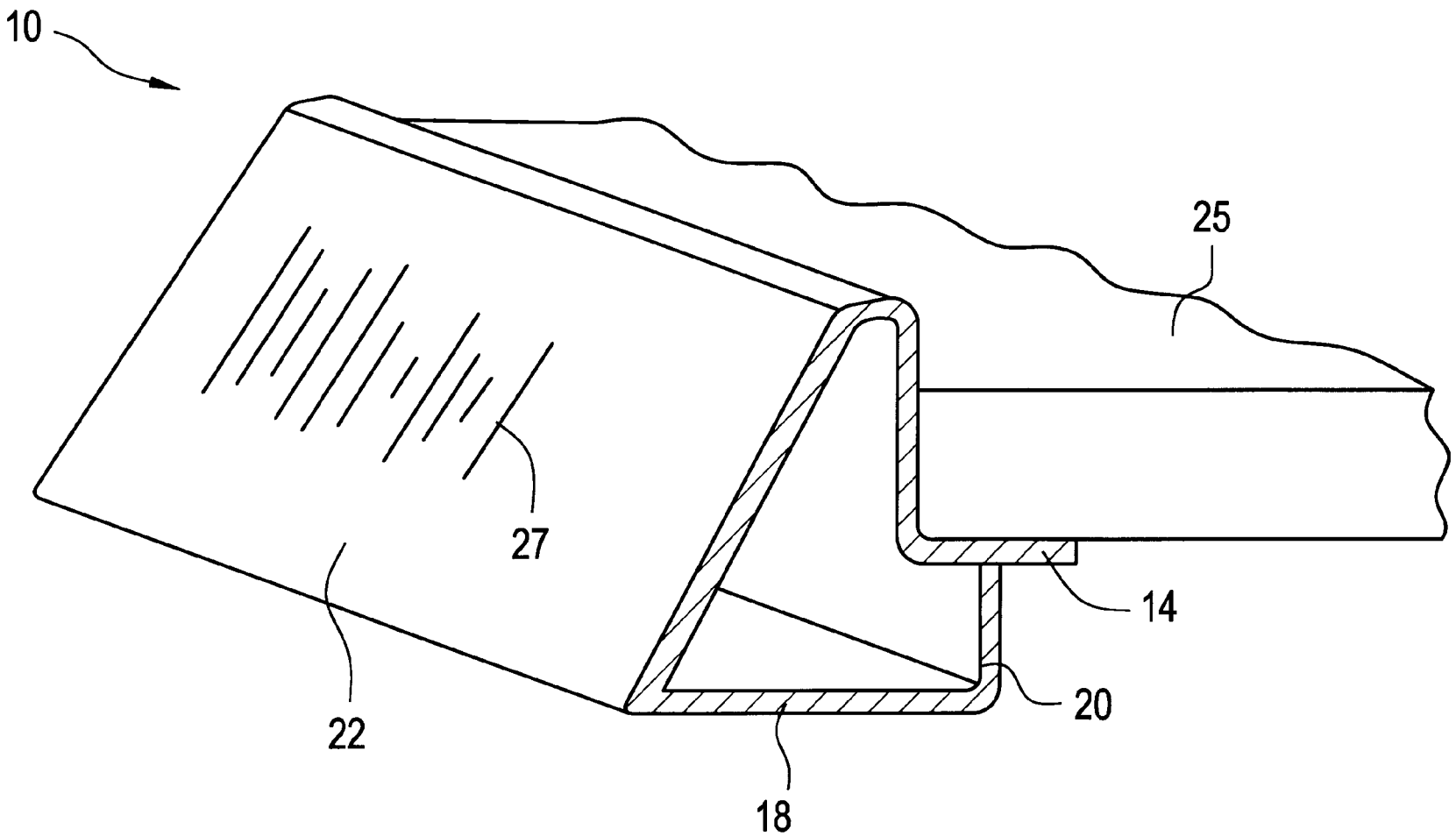
FIG. 2 depicts a frontal downward rightward isometric view of a beam supporting an article in accordance with the present invention.

FIG. 2 depicts the beam of either FIGS. 1A or 1B when an load 24 is placed on the support element 14. It should be understood that the load 25 can be a storage rack platform or shelf or any object capable of storing products or articles. When the load 25 is placed on the support element, the continuous base portion will be in contact with a floor or other flat surface to insure stability from bending and deflection of the loaded beam. It should be appreciated, however, that the beam 10 can be placed on any flat surface such as a floor, board, crate top or the like.

Also shown in FIG. 2 is a bar code 27 positioned on display portion 22 for identifying information relating to the products stored in the article 25. Product information may include product identity, color, size, price or any other information deemed useful or relevant to workers and customers. The beveled display portion allows workers or customers easily to read or scan the information from a height above the beam 10 without having to bend over. It should be appreciated that other information, such as human-readable information, can be positioned on display portion 22 either in lieu of or in combination with the bar code 27.

Figure 3:
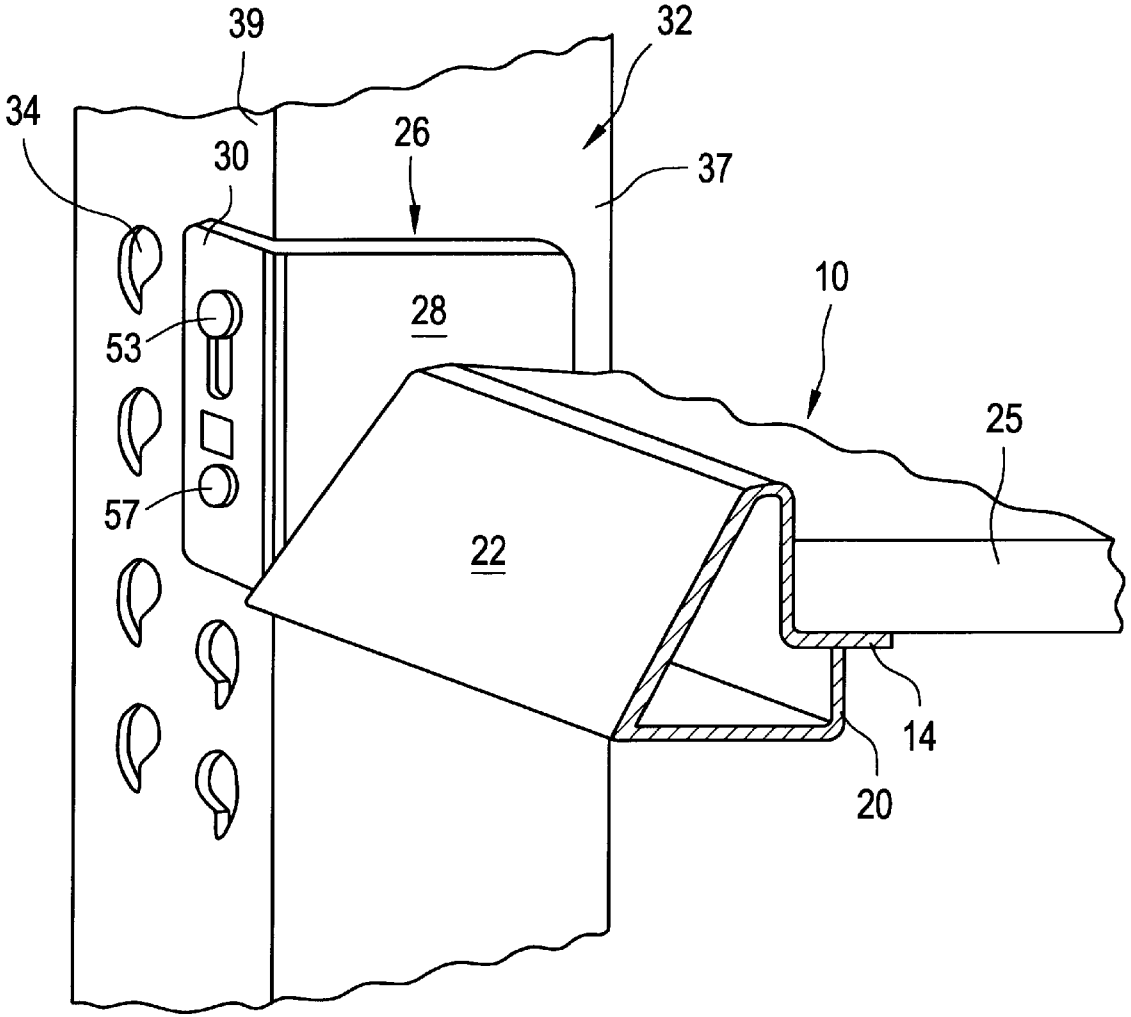
FIG. 3 depicts the beam of FIG. 2 attached to a column, in accordance with the present invention.

FIG. 3 depicts the beam 10 attached to a column 32. The column 32 comprises an inner surface 37, a front surface 39 and a series of apertures 34. The beam generally designated 10 is attached to the column 32 by a mounting mechanism generally designated 26. Specifically, the mounting mechanism 26 includes an inner plate 28 and a front plate 30 that rest against the inner surface 37 and the front surface 39, respectively. The mounting mechanism 26 is secured fixedly to the beam 10 by known means, such as welding. Moreover, the mounting mechanism 26 and the beam 10 preferably are attached to the column 32 by means of a stud 53 and a lock 57 of known design such as in U.S. Pat. No. 5,938,367 to David S. Olson the disclosure of which is incorporated herein by reference. However, it should be understood that the mounting mechanism 26 and beam 10 can be secured to the column 32 by other suitable means known to those of ordinary skill in the art. For example, attachment can be achieved by wedge connectors, bolts or, if a permanent attachment is desired, by welding.

The use of the mounting mechanism 26 allows the beam 10 to be secured at various heights along a structure, such as the column 32. The mounting mechanism 26 eliminates the need for the base portion 18 of the beam 10 to sit on a surface such as a floor. In addition, the attachment of the beam 10 to a column 32 allows for shelving-like storage of products where the load 25 is a platform, board or pallet.

Figure 4:
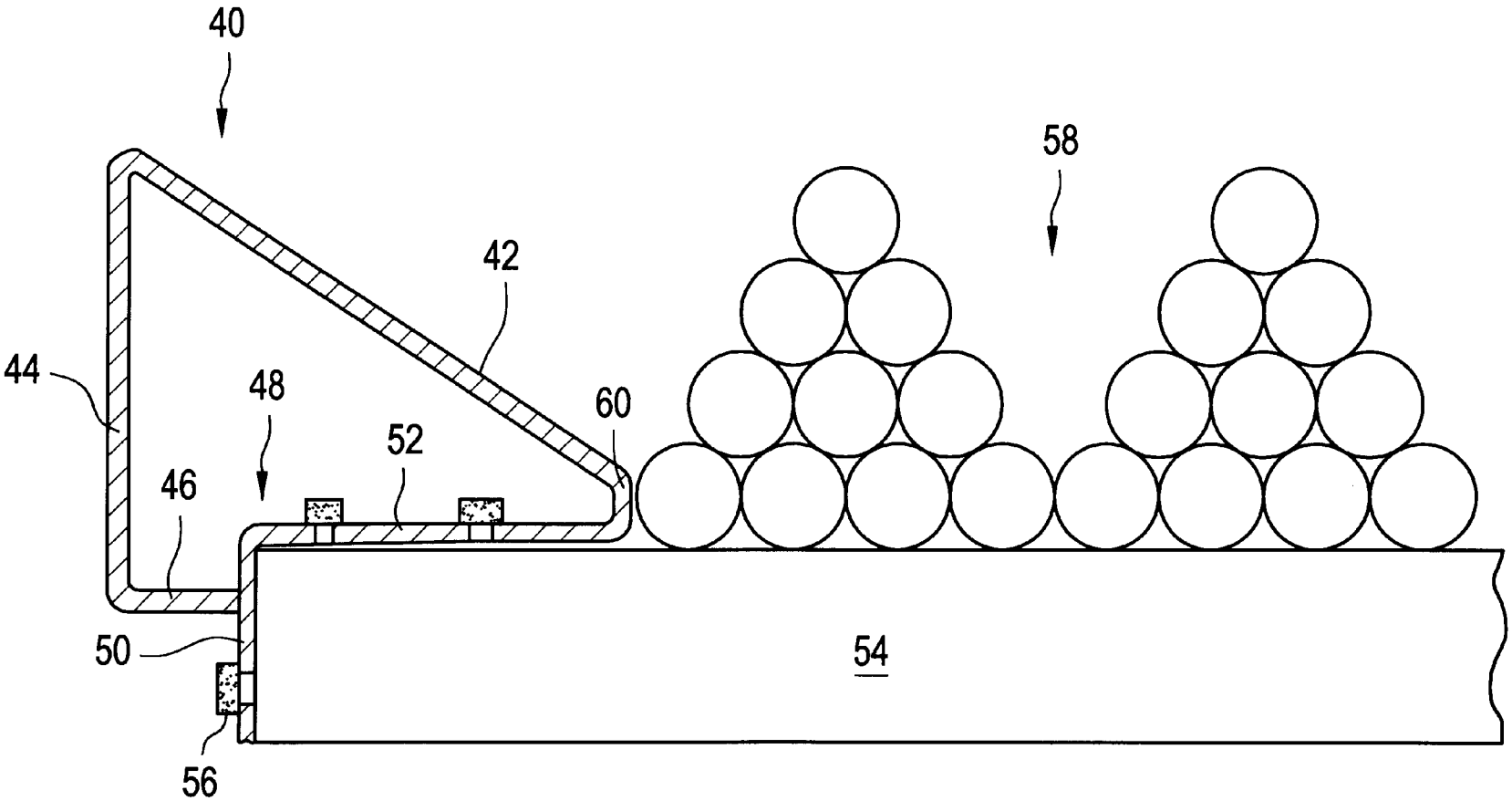
FIG. 4 depicts a cross-sectional view of a beam, in accordance with a second alternative embodiment of the present invention.

FIG. 4 depicts a cross-sectional view of a retaining beam 40. Specifically, the retaining beam 40 comprises an angled base portion 48 having a first element 50 and a second element 52, a stabilizing portion 44 having an end 46 turned towards and joined to the first element 50, and an inclined portion 42 preferably joined to the second element 52 of the angled base portion 48 by abutment portion 60. As shown, the retaining beam 40 is joined to a platform 54, such as a shelf by means of stud connectors 56. The stud connectors 56 enter large diameter holes in the second element 52 and are then shifted side wise to portions of the holes with smaller diameters to engage heads of the studs. The stud connectors are then restrained in said engagement. It should be understood that attachment of the retaining beam 40 to the platform 54 can be achieved by other means known in the art. For example, connection can be achieved by welding, adhesive, etc. In addition, it should be appreciated that the end turned 46 can be positioned distally adjacent the second element 52 instead of being joined thereto.

Once attached to the platform 54, the retaining beam 40 can prevent products 58 from falling off the platform 54. For example, if products 58 are cylindrical, they may roll off the platform 54 and injure a worker or customer. However, when retaining beam 40 is attached to the platform 54, the abutment portion 60 and the inclined portion 42 serve as a stop for the products and accordingly, prevent the same from rolling off the platform 54.

It should be understood that the beams 10–10A and retaining beam 40 can have any dimensions deemed suitable by the user and the illustrations shown in the figures are not intended to be limiting. For example, the length, width and/or height of the beams 10–10A and 40 can be different than shown in the figures.

The foregoing description of the preferred embodiments of this invention has been presented for purposes of illustration and description. It is not intended to be exhaustive or to limit the invention to the precise form a practical examples disclosed, and obviously, many modifications and variations are possible. Such modifications and variations that may be apparent to a person skilled in the art are intended to be included within the scope of this invention as defined by the accompanying claims.

What is claimed is:

1. A beam comprising:

a support element having a first end and a second end;

a base portion having a turned portion, wherein the turned portion is positioned between the first end and the second end; and a display portion joined to the base portion.

2. The beam as claimed in claim 1, further comprising a brace portion for joining the display portion and the support element.

3. The beam as claimed in claim 2, wherein the display portion joins the base portion and the brace portion.

4. The beam as claimed in claim 2, wherein the turned portion is substantially coplanar with the brace portion.

5. The beam as claimed in claim 1, wherein the display portion is inclined.

6. The beam as claimed in claim 1, wherein the turned portion is joined to the support element.

7. The beam as claimed in claim 1, wherein the turned portion is adjacent the support element.

8. The beam as claimed in claim 1, further comprising a mechanism for attaching the beam to a column.

9. A beam comprising:

a first portion having a first end and a second end;

a second portion joined to the first end of the first portion;

a third portion extending angularly from the second end of the first portion; and a bent portion having a first element and a second element, wherein the first element is joined to the second portion, and wherein the third portion extends towards the second element.

10. The beam as claimed in claim 9, wherein the second portion is beveled with respect ot the first portion.

11. The beam as claimed in claim 9, wherein the third portion is joined to the second element.

12. The beam as claimed in claim 9, wherein the third portion is adjacent the second element.

13. The beam as claimed in claim 9, wherein the third portion is co-planar with the first element.

14. The beam as claimed in claim 9, further comprising a mounting device for attaching the beam to a column.

15. A retaining beam, comprising;

an angled base portion having a first element and a second element;

an inclined portion joining the second element to the angled base portion;

a stabilizing portion having an end turned towards the first element of the angled base portion;

a connector for joining the angled base portion to an article.

* * * * *